US006042089A

United States Patent [19]

Klein

[11] Patent Number: 6,042,089

[45] Date of Patent: Mar. 28, 2000

[54] FOAM GENERATING DEVICE

[76] Inventor: Christophe Klein, 84, rue Ordener, F-75018 Paris, France

[21] Appl. No.: 09/029,417

[22] PCT Filed: Jul. 1, 1997

[86] PCT No.: PCT/FR97/01167

§ 371 Date: Feb. 26, 1998

§ 102(e) Date: Feb. 26, 1998

[87] PCT Pub. No.: WO98/00227

PCT Pub. Date: Jan. 8, 1998

[30] Foreign Application Priority Data

| | | | |
|---|---|---|---|
| Jul. 1, 1996 | [FR] | France | 96 08162 |
| Sep. 9, 1996 | [FR] | France | 96 10947 |
| Jan. 23, 1997 | [FR] | France | 97 00690 |

[51] Int. Cl.[7] ..... B01F 3/04

[52] U.S. Cl. ..... 261/76; 261/81; 261/DIG. 26; 261/DIG. 75

[58] Field of Search ..... 261/76, 81, DIG. 26, 261/DIG. 75

[56] References Cited

U.S. PATENT DOCUMENTS

| | | | |
|---|---|---|---|
| 2,852,239 | 9/1958 | Vicard | 261/76 |
| 3,838,002 | 9/1974 | Gluntz et al. | 176/65 |
| 4,098,851 | 7/1978 | Schulte et al. | 261/DIG. 75 |
| 4,308,138 | 12/1981 | Woltman | 261/DIG. 75 |
| 4,333,833 | 6/1982 | Longley et al. | 261/DIG. 75 |
| 4,802,630 | 2/1989 | Kromrey et al. | 239/428 |
| 4,861,165 | 8/1989 | Fredriksson et al. | 261/76 |
| 5,054,688 | 10/1991 | Grindley | 261/DIG. 26 |
| 5,061,406 | 10/1991 | Cheng | 261/76 |
| 5,085,371 | 2/1992 | Paige | 239/343 |
| 5,275,763 | 1/1994 | Fukai | 261/DIG. 26 |
| 5,431,346 | 7/1995 | Sinaisky | 239/399 |

FOREIGN PATENT DOCUMENTS

| | | |
|---|---|---|
| 2301710 | 9/1976 | France . |
| 1249223 | 9/1967 | Germany . |
| 2026093 | 1/1980 | United Kingdom . |
| 2189843 | 11/1987 | United Kingdom . |
| 2203065 | 10/1988 | United Kingdom . |
| WO 95/31287 | 11/1995 | WIPO . |

OTHER PUBLICATIONS

International Search Report pp. 1–3.

*Primary Examiner*—C. Scott Bushey
*Attorney, Agent, or Firm*—Duane, Morris & Heckscher LLP

[57] ABSTRACT

A device for generating foam by the Venturi effect mixes liquid and gaseous phases. The device has a liquid insertion nozzle on the same axis as a Venturi stage having a converging portion disposed facing the nozzle, a throat of diameter "D", and a gas inlet coaxial with the nozzle and in communication with the converging portion. In operation, the gas is sucked in by the Venturi effect and directed towards a mixing chamber connected to a foam outlet. Mixing between the two phases takes place in a free jet, and the diverging portion of the Venturi has at least three zones of progressive cone angles, with discontinuities between the zones giving rise to a cavitation phenomenon, and opening out into a turbulent chamber.

13 Claims, 4 Drawing Sheets

FOAM GENERATING DEVICE

BACKGROUND OF THE INVENTION

Numerous systems are in use for making foam for various applications where the physical properties of foam (low density and high contact area, thixotropical qualities) provide a significant improvement over the intrinsic qualities of the substance dispensed in liquid form. By way of example, systems for producing foam are used for applying an active substance on a surface that is to be cleaned, degreased, asepticized, depolluted, chemically deactivated, or neutralized.

In all applications that use a foam, it is always desirable to reduce bubble size pro rata the gas in the liquid. This reduction in bubble size increases the contact area with the medium that is to be treated per unit mass of active substance. Numerous foam dispersion systems use a nozzle which atomizes the substance at the outlet from the apparatus and gives rise to a foaming effect by spraying at high speed a large number of fine droplets containing a substance that foams on impact.

Over the last few years, foam generator systems have progressed with the introduction of systems that make it possible, in particular, to inject a gas and a liquid simultaneously into a liquid-gas-liquid dispersion space which can be adjustable to adjust the fraction of added gas, as described in WO 95/31287. However, even if the gas content can thus be significant, there is no action of bubbles being split up by cavitation and so bubble size remains visible to the naked eye.

Others, e.g. U.S. Pat. No. 5,085,371, make use of mechanical elements in the form of obstacles (a grid in the document mentioned) or guides that establish turbulent conditions instead of laminar conditions, thereby enhancing gas-liquid mixing.

The efficiency of such a system can be verified completely and easily by determining the percentage of active substance that is needed in solution to accomplish a given action which can be quantified per unit area.

Although the above-mentioned solutions significantly improve the production of foam compared with more primitive systems, they do not achieve optimum mixing and fineness of gas bubbles in the liquid.

Furthermore, when using an atomizing nozzle, the foam is always formed after it has left the system, which causes bubbles to be formed under static atmospheric pressure and as a result bubble size is large and the contact area and the wetting activity of the foam cannot be optimized. In most washing systems in use, the outlet nozzle is adapted to atomize the fluid by increasing the pressure and speed parameters of the fluid, thereby reducing static pressure, since the potential energy of static pressure is transformed in this way into kinetic energy.

When a liquid-gas fluid passes through a diverging portion, its speed decreases and its static pressure conditions exceed a certain value, so gas bubbles can no longer continue to expand, so under the effect of pressure they then implode and break up into a plurality of cavities of much smaller dimensions. This implosion is accompanied by shock waves that are very large compared with the dimensions of the cavities associated with a high speed of the walls of said cavities. This phenomenon is studied in detail by Hammit, "Cavitation and multiphase phenomena", MacGraw Hill 1980. In particular, he describes cavitation phenomena in a conical diverging portion of a Venturi tube.

However, in most existing uses, the cavitation phenomena must be avoided since otherwise proper operation of the nozzles is hindered.

OBJECTS AND SUMMARY OF THE INVENTION

An object of the present invention is to form a foam of minimum density that is as uniform as possible, using the cavitation phenomenon which has been avoided in the prior art. With a fluid containing a foaming wetting agent, proper operation of the system gives rise to gas volume values exceeding 90% in the final mixture.

The invention provides a device for forming foam by the Venturi effect, mixing a substance in liquid phase and a substance in gas phase, the device comprising a liquid insertion nozzle on the same axis as a Venturi stage comprising a converging portion disposed facing the nozzle and having a throat of diameter "D", and a gas inlet coaxial with the nozzle and in communication with the converging portion, the gas being sucked in by the Venturi effect and directed to a mixing chamber connected to a foam outlet, wherein the diverging portion of the Venturi comprises at least two zones of progressive conicity with breaks between the zones, co-operating with the determined shape of the Venturi to cause cavitation and opening out into a turbulence chamber.

The device makes use of the difference in kinetic energy between the kinetic energy of the free incident liquid jet issued by the nozzle, giving rise to conical dispersion that comes into contact with the converging portion having a throat diameter "D", thereby reducing the speed of liquid-gas mixing and reducing its pressure, and the kinetic energy of the liquid gas mixture at lower pressure, which difference is stored in the form of potential energy in the bubbles of gas during suction into the jet and during compression in the converging portion of the Venturi. This energy is released in the form of cavitation energy in the diverging portion of the Venturi which has sections of progressive conicity, thereby creating the cavitation phenomenon due to the excess of gas in the liquid, associated with the increase in static pressure and the decrease in fluid speed in the diverging portion and in the turbulence chamber located downstream from the diverging portion. Because of the breaks in the conicity, a turbulent zone forms in the diverging portion which is also subjected to cavitation waves that break up the bubbles to submillimeter dimensions. If active substances, and in particular wetting agents, are used in an appropriate concentration in the liquid-gas mixture, then a foam is obtained of very low density, with the chemical substances being subjected to cavitation forces and therefore being highly ionized and polarized, having a large contact area due to the fineness of the bubbles, thus conferring exceptional activity to the mixture, and as a result, on application of the mixture via a nozzle, the jet is, in fact, constituted by a mass of bubbles.

The present invention uses a nozzle that creates a free jet of low conicity, a convergent throat adapted to the size of the jet and followed by a diverging portion. The assembly serves to suck in gas from upstream of the throat by the Venturi effect and to use the gas sucked-in in this way to establish cavitation conditions on the walls of said diverging portion. Unlike other uses as described above, this diverging portion forms an inlet and a turbulence-creating wall for a turbulence chamber.

Said chamber may advantageously be fitted with a device enabling the mixture it contains to be excited by means of ultrasound waves in the turbulence chamber.

An object of the present invention is to provide a device for producing low-density foam, i.e. foam containing a high proportion of gas and having a large contact area with the surface on which it is sprayed on leaving the system. For the purpose of atomizing the liquid while it is being projected, the device makes use of the forces generated in a stabilization chamber by the cavitating pressure drops, even though they are under control.

The present invention also provides self-contained apparatus for generating foam that makes use of the above device, which apparatus achieves bubble uniformity and small size, enabling the active substance to have a contact area and an active area that are raised to levels that have never been achieved in conventional foam-producing systems.

Another object of the invention is to produce a two-phase mixture in which bubbles are of a size that is as small as possible, i.e. in any event of a diameter smaller than 20 microns. The combination of cavitation, of turbulent flow, and optionally of energy delivered in the form of ultrasound, makes it possible to maximize subdivision of gas bubbles present in the fluid and to form a stable foam at the outlet from said chamber. In addition to making foam, the device also makes it possible to mix and measure out an incident fluid under pressure with a sucked-in gas, and to generate bubbles, aerosols, or emulsions.

Since the volume of the mixture increases very considerably on passing through said chamber, and since its speed increases perceptibly, it is necessary to fit a return pipe on the high pressure inlet to enable the system to adapt automatically by regulating flow rate, with such regulation being known per se.

The system adapts perfectly if the pressure drop measured upstream from the neck of said nozzle outside the high pressure incident free jet is (for example) greater than 1 bar or more generally close to the maximum for the fluid under consideration. The distance between the outlet from the nozzle and the throat has an influence on the size of the gaseous cavities admitted into the Venturi and on the quantity of gas that is admitted, and according to the invention, it should lie in the range 2d to 20d (where d is the outlet diameter of the nozzle), depending on the length of said free jet, the diameter D of the throat should lie in the range 1d to 4d.

BRIEF DESCRIPTION OF THE DRAWINGS

Other characteristics and advantages of the present invention appear from the following description of a particular embodiment given purely by way of non-limiting example and with reference to the figures in which.

MORE DETAILED DESCRIPTION

Figure 1:
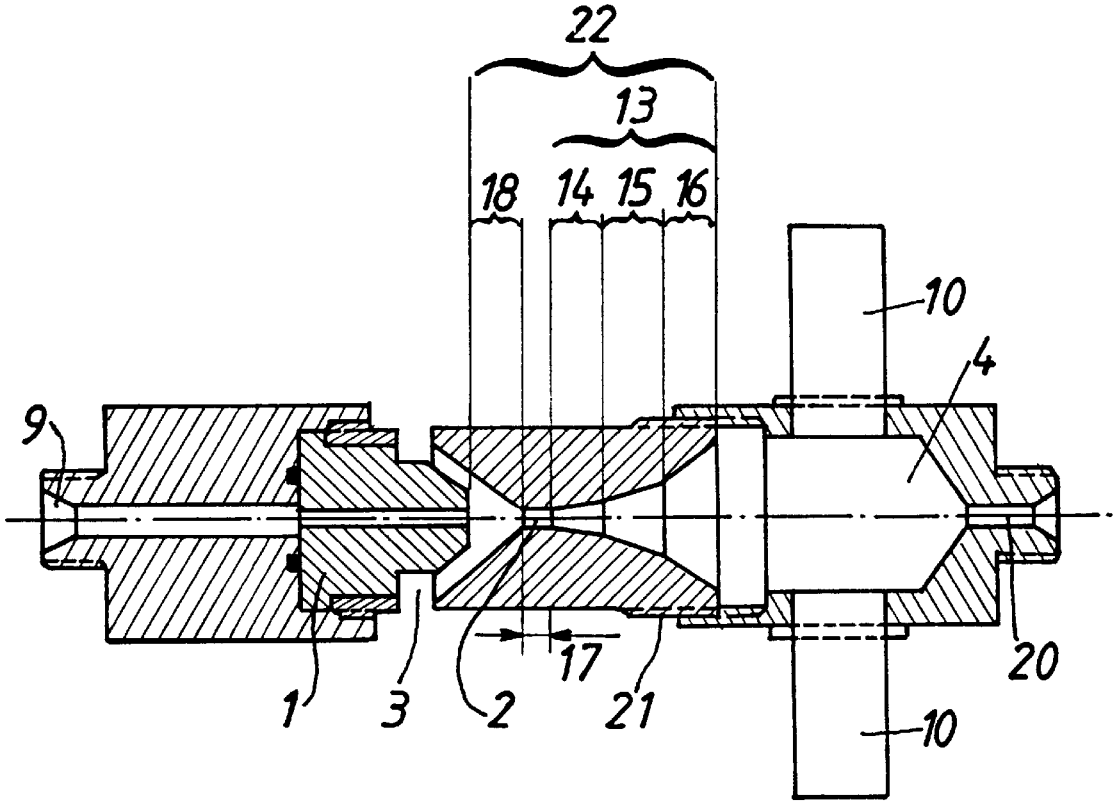
FIG. 1 shows an embodiment of the invention in section.

In the embodiment of the invention shown diagrammatically in FIG. 1, a nozzle 1 is adapted to disperse a fluid with determined flow rate and pressure parameters in a cone having a small angle at the apex (<20°) and receiving feed liquid at high pressure from a feed channel 9. In this example, a pressure of 100 bars can be considered as typical but not limiting: values lying in the range 20 bars to 500 bars can be specified for various applications. In FIG. 1, the active element includes two ultrasound wave generators 10 that are positioned radially on the turbulence chamber 4.

The diverging portion has three zones of increasing conicity 14, 15, and 16, the first zone 14 having an angle $\alpha 1$ lying in the range 0 to 10°, the second zone 15 having an angle $\alpha 2$ that is at least 5° greater than the angle $\alpha 1$ presented by the first zone so that the lines separating the zones are situated at distances lying in the range 2D to 4D for the line between zones 14 and 15 (second zone inlet diameter), and in the range 5D to 8D for the line between zones 15 and 16 (second zone outlet diameter) relative to the line X, 14 marking the outlet of the throat X of conicity 0°. The third zone 16 has an angle at the apex $\alpha 3$ that is at least 15° greater than the angle $\alpha 1$ and less than the value of the angle al plus 35°, and it is of a length that is less than 20D. The diverging portion 13 preferably includes surface discontinuities such as groove lines or grids.

The mixing chamber, which is adjustable in length by means of a thread 21, is of a length greater than 20D and its outlet opens out into a duct 20.

The fluid, which depending on the application of the invention can be constituted by one or more active principle (s), optionally in solution, optionally in emulsion, optionally containing a solvent, or any other liquid having specified physico-chemical characteristics or characteristics suitable for a given application, is ejected as a jet on the axis of the Venturi tube 22.

According to the invention, the two phases are mixed in a free jet, i.e. the static pressure exerted by the gas on the jet is the pressure of the gas at the inlet to the slots 3 (or a gas inlet for feeding the Venturi with gas).

Figure 2:
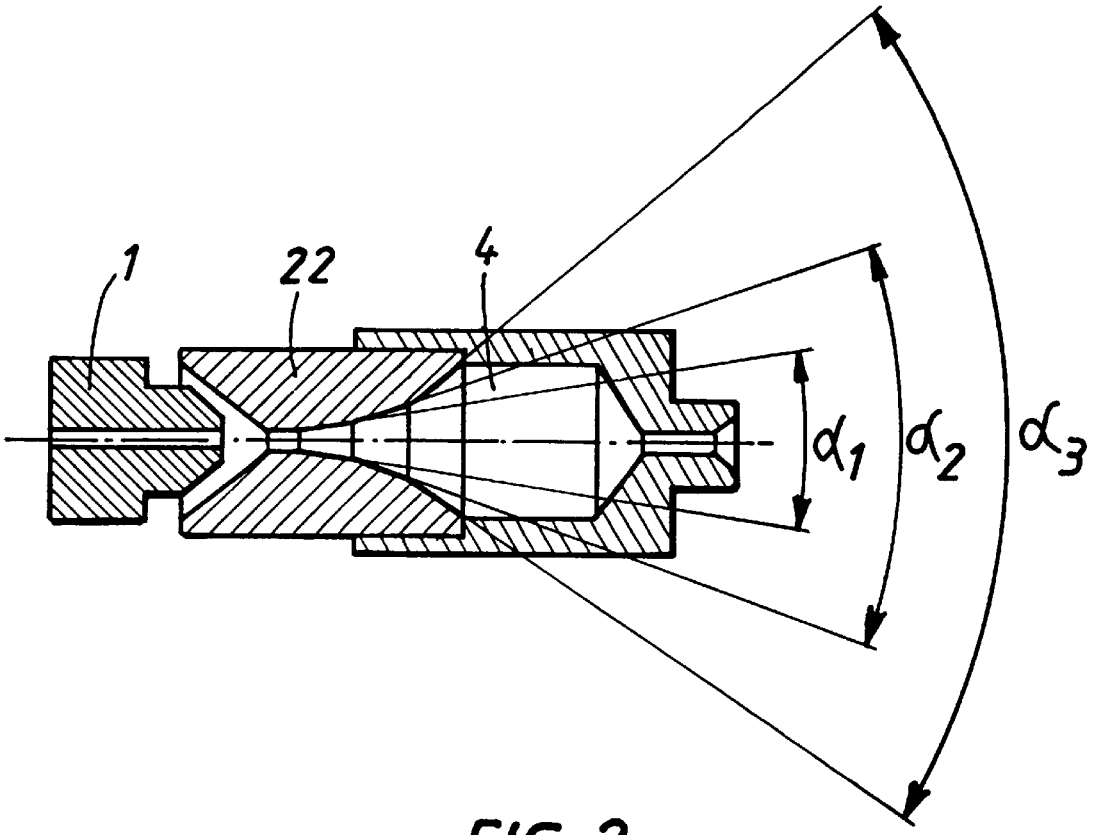
FIG. 2 shows a detail of the diverging portion of the Venturi.

FIG. 2 shows a preferred embodiment of the Venturi diverging portion of the invention in detail. This embodiment has three successive conical portions with increasing angles at the apex: $\alpha 1$, $\alpha 2$, and $\alpha 3$.

Figure 3:
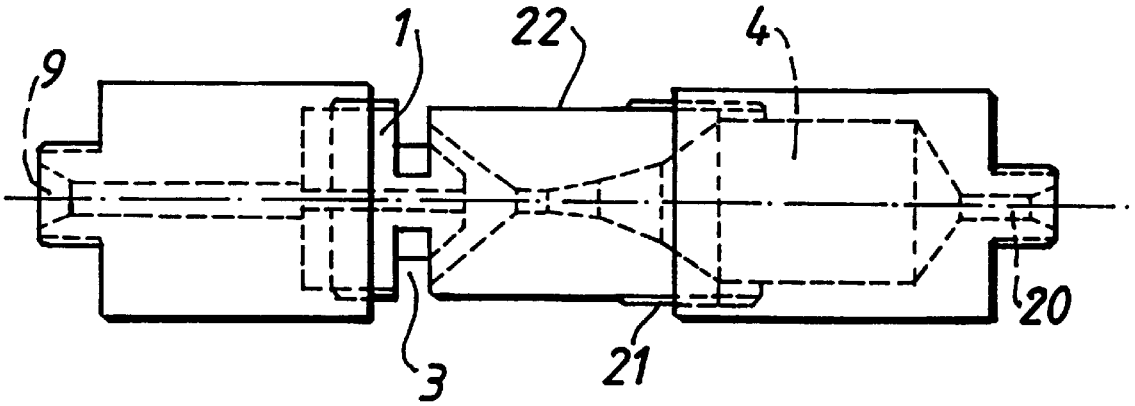
FIG. 3 is an outside view of an embodiment of the apparatus of the invention.

FIG. 3 shows a device which does not include an ultrasound exciter, but which does include, as in FIG. 1, a gas suction opening in the form of a circular slot.

The increase in the inlet pressure of the gas provides some assistance in increasing the amount of gas admitted into the throat 2. By way of example, if the gas is air and the incident jet is an aqueous solution at the above-mentioned high pressure, pressurizing the incident gas to 10 bars increases the amount of gas admitted by at least 50%. Beyond a certain value, and if said pressure continues to be increased, its effect on the free jet becomes neutral and then detrimental, and possibly leading to turbulence phenomena in the converging portion 18 and even to cavitation phenomena in the throat at high pressures for the gas and the incident jet, and that is undesirable.

The shape of the diverging portion and of the turbulence chamber generate a large amount of suction upstream from the Venturi, thereby enabling the foam producing system to operate very well and considerably better than other systems even without pressurizing the gas. The advantage of the invention of introducing the gases is to introduce by this means via the inlet 3 gas that has action or activity that is specific to the application of the method. For example, ozone could be used in an asepticizing application and indeed in certain depollution applications, halon gases can be used in fire-fighting applications, and nitrogen or nitrous oxide can be used in applications involving food, cosmetic or pharmaceutical emulsions.

The gas cavities which are formed while the jet is free because of the Venturi suction are entrained at the flow speed of the jet into the Venturi. After passing through this discontinuity, the two-phase mixture is subjected to a single-direction flow which, to a first approximation, is described by Bernouilli's equation:

$$P+V^2/2g=\text{constant}$$

where:

P is the static pressure of the mixture;

V is the speed of the fluid; and g is the acceleration due to gravity.

At the inlet to the converging portion of the Venturi, the cavities are subjected to a static pressure and they take the form of bubbles, however the cavitation phenomena does not apply because of the increase in the speed of the fluid. In particular, on passing through the throat, the static pressure decreases and the speed of the mixture increases relative to the entrance of the jet into the Venturi: the speed of the mixture must be greater than a certain limit that depends directly on the Reynolds number defining the nature of the fluid. Above a Reynolds number of 3000, the liquid passes progressively into a turbulent flow, otherwise for smaller Reynolds numbers, the flow becomes more laminar. For flow in a rectilinear tube of circular section, the Reynolds number is given by the following formula:

$$Re=V.D.r/m$$

where:

D is the diameter of the section;

V is the speed of the liquid;

r is its density; and m is its viscosity.

The cavitation phenomenon is not possible for Re<2300. Below this value the speed of the liquid increases in the passage and its static pressure decreases, but not enough to enable the creation of cavities that are the precursors to cavitation. Known systems must operate at Re>2300 to create cavitation since the gas or the vapor is mixed with the fluid upstream from the system.

In the present invention, mixing takes place at the pressure at which gas is inserted into the free jet, and the cavitation precursors are formed by transforming the kinetic energy of the incident fluid into static compression potential energy at the moment when the free jet comes into contact with the converging portion 18 of the Venturi, it is this energy released in the form of cavitation energy on the walls of the diverging portion 15, 16 which generates chaotic conditions inside the chamber 4.

The criterion for operation of the device is that the flow is non-turbulent in the neck 2 (having a Reynolds number in the range 2300 to 3000) and enables cavitation to take place in the diverging portion 13. Also, the volume fraction of gas can exceed 50% and can even reach or exceed 80% in some cases. With such fractions, bubbles and fluid containing cavities coexist at the outlet from the neck 2, insofar as the active principles or substances contained in the fluid contain a sufficient quantity of wetting agents, said already-formed bubbles being sucked into the axis of the chamber 4 which is at a lower pressure than the walls, where they are subjected to turbulent conditions and to shock waves from cavitation close to the walls, thereby causing successive bursting and implosion, leading to the formation of microscopic bubbles. This chaotic turbulence phenomenon is not due only to cavitation, it can also be attributed to the special shape of the diverging portion of the invention having three successive cone angles.

The changes in cone angle, i.e. the discontinuities, in the diverging portion 17 cause turbulence to be formed which contributes to slowing down the fluid and which favors cavitation which occurs firstly along the walls where the static pressure rises fastest. The potential energy absorbed by the bubbles on passing through the Venturi is restored during cavitation to the turbulent medium in the form of shock waves. The kinetic energy released in this way propagates the cavitation phenomenon, atomizes the liquid, and enables submillimeter bubbles to be obtained.

The angle at the apex $\alpha_1$ of the first length 14 of the diverging portion is preferably less than 10°. This angle is constant along said length, or else it can vary continuously from 0° to the selected value below 10° in order to avoid or at least reduce as much as possible the phenomenon of cavitation in this location, since cavitation would then prevent the apparatus from being optimized. The angle at the apex $\alpha_2$ of the second length 25 must be at least 10° greater than the angle given above for the first length in order to maximize the cavitation phenomenon in this location. Similarly, the angle at the apex $\alpha_3$ in the third length 16 must be at least 10° greater than that of the length 15, for the same reasons.

According to the invention, the outlet 20 from the chamber 4 lies on the same axis as the throat 2. Whatever the fluid used, bubbles of very small size are formed at the outlet from the diverging portion 13; when the fluid is not reactive or has high surface tension, these bubbles disappear very quickly on leaving the chamber, and even if the cavitation effect breaks up molecules and enhances the creation of free radicals, the substance will leave the system practically in liquid form and will return very quickly to liquid form when the mixture is dispersed as a free jet.

In contrast, when the substance contains a sufficient quantity of foaming or surfactant compounds (ionic or non-ionic), the microbubbles formed by the method generate a very lightweight foam having very good thixotropical qualities, which foam is also very uniform and conserves its properties even after it has been dispersed in free air. Under the same pressure conditions as in the chamber 4, a foam containing a sufficient quantity of surfactants (typically >0.5% by mass of fluid) can be conserved for several minutes while retaining its activity. After 5 minutes, less than 10% of the volume of the mixture returns to liquid form under normal operating conditions at ambient temperature. This result is considerably better than those obtained by conventional means at higher concentrations.

The use of such appropriate substances makes it unnecessary to close the downstream chamber, the foam being formed in the diverging portion 13 and then flowing after homogenization until it disperses in a nozzle matching the throat 2 in pressure and flow rate, which outlet nozzle may be situated several tens of meters from foam formation in the diverging portion. It is even possible, in accordance with the invention, to organize foam distribution in a network starting from a single source.

An essential feature of the foam formed in accordance with the invention is the formation of microscopic or even micron-sized bubbles in the chamber 4. This distinctive property makes it possible on the substance being dispensed through an appropriate nozzle to avoid dispersing droplets as happens in most systems, while ensuring that small bubbles diffuse and even diffusing, in most cases, agglomerations of microbubbles. In free air, these naturally tend to expand and to group together. However the uniformity and the large contact area produced by the foam reinforce the action of the active substances and make it almost instantaneous, particularly with ionic compounds, polar compounds, and surfactants. This property is conserved for several minutes providing the thickness of the spread foam per unit area is sufficient compared with the quantity of substance relative to area. Reaction of the active compound in the foam mixture, and in particular of a surfactant, with the medium to be treated causes the bubbles involved in the reaction to disappear. This phenomenon can easily be seen by the user of the apparatus or of the method, thereby enabling the user to apply extra substance where necessary, e.g. on portions that are dirtier or more polluted.

It is also possible to use appropriate metering systems upstream from the apparatus to inject various substances that are not necessarily miscible with one another: for example water and oil, solvent and detergent, active substance and solvent, etc. The incident jet is then formed by a mixture that is locally non-uniform, but that is nevertheless accurately measured out, said mixture then being properly emulsified on passing through the apparatus, even though the conditions under which foam is formed, and thus the final properties of the foam, are nevertheless modified by the natures and by the proportions of the fluids used.

In the preferred embodiment of the invention, the length 14 of the diverging portion is 1.5 to 5 times the diameter D of the throat 2, nevertheless this portion can be extended to as much as 30 times said length if required by the application, providing the cone angle varies continuously from 0° to the selected value less than 100 at the outlet from said length, with this being done to limit the cavitation phenomenon in this stage.

According to the invention, the preferred lengths for the other lengths lie in the range 1 to 6 times the diameter of the throat 2 for the portion marked 15 in FIG. 1, and less than 30 times the same diameter for the portion 16, however these values must be adapted depending on the main use of the invention concerning aqueous solutions, and different lengths can be envisaged for other fluids or for emulsion type mixtures.

In the preferred embodiment of the invention, the diverging portion 13 has three zones of increasing cone angle with breaks between the zones. The diverging portion may also have a number of zones other than three, and the cone angles of the zones may vary continuously, with the breaks being softened. The dimension of the outlet section 20 is determined as a function of the area of the throat 2 so as to have an area lying in the range 1.2 to 3 times the area of said throat, and greater values can be envisaged for high concentrations of surfactants and a greater quantity of gas per unit volume of liquid.

In the diverging portion 13, the mixture enters the first length having a small apex angle (<10°) determined depending on conditions of flow rate, pressure, and gas concentration, so that static pressure does not increase too suddenly, thus creating conditions that prevent gas bubbles imploding in this first length of the diverging portion.

Because of the high speed reached by the fluid on passing through the throat, and because the chamber 4 is in continuous conditions of said mixture flowing and is full of said mixture, the preferred flow of the fluid at the outlet from the first length is laminar along its walls. On passing through the second length, a major portion of the fluid remains along the wall of the diverging portion 15, with this portion of the fluid then being subjected to high static pressure because of the angle of this length of the diverging portion and because of the turbulence which contributes to reducing speed.

Mixing in the vicinity of said wall then takes place under conditions that are ideal for cavitation. The gas bubbles implose, releasing the energy stored during their formation at the inlet of the Venturi. This release of energy leads to bubbles disappearing and to microbubbles being formed, and in addition it can break atomic or molecular bonds. The metal of the walls is then subject to a combination of violent shock waves and major electrochemical couples. To guarantee prolonged proper operation of the apparatus operating in accordance with the present invention, it is necessary for the mechanical part that forms the Venturi to be made of a metal or any other material that withstands this phenomenon. An alloy based on special cast iron or on treated steel can commonly last for more than one year in continuous operation without significant deterioration of the quality or the activity of the foam produced.

The same process is repeated in the third length. The cavitation phenomenon takes place essentially in the vicinity of the walls, with the atomization of the bubbles and the liquid that results therefrom having components that are essentially radial, thereby imparting chaotic motion to the central portion of the chamber, and in addition cavitation generates ultrasound waves which are reflected on the walls and which have energy that is absorbed by the mixture and which contributes to chaotic stirring.

In the optimized embodiment of a device of the present invention, the additional use of ultrasound wave generators is unnecessary, however if all three successive cone angles are not well adapted to the required flow rate and pressure conditions, then the suction generated by the Venturi will remain below 0.9 bars, and feeding energy to the foam that is in the process of being formed inside the chamber 4 can serve to compensate for this lack of optimization.

The present invention also seeks to provide self-contained foam-producing apparatus, using the special properties of the Venturi as described above. The pressure can be generated by various means such as a bottle of gas under pressure, a pyrotechnic generator, or a steam generator.

Figure 4:
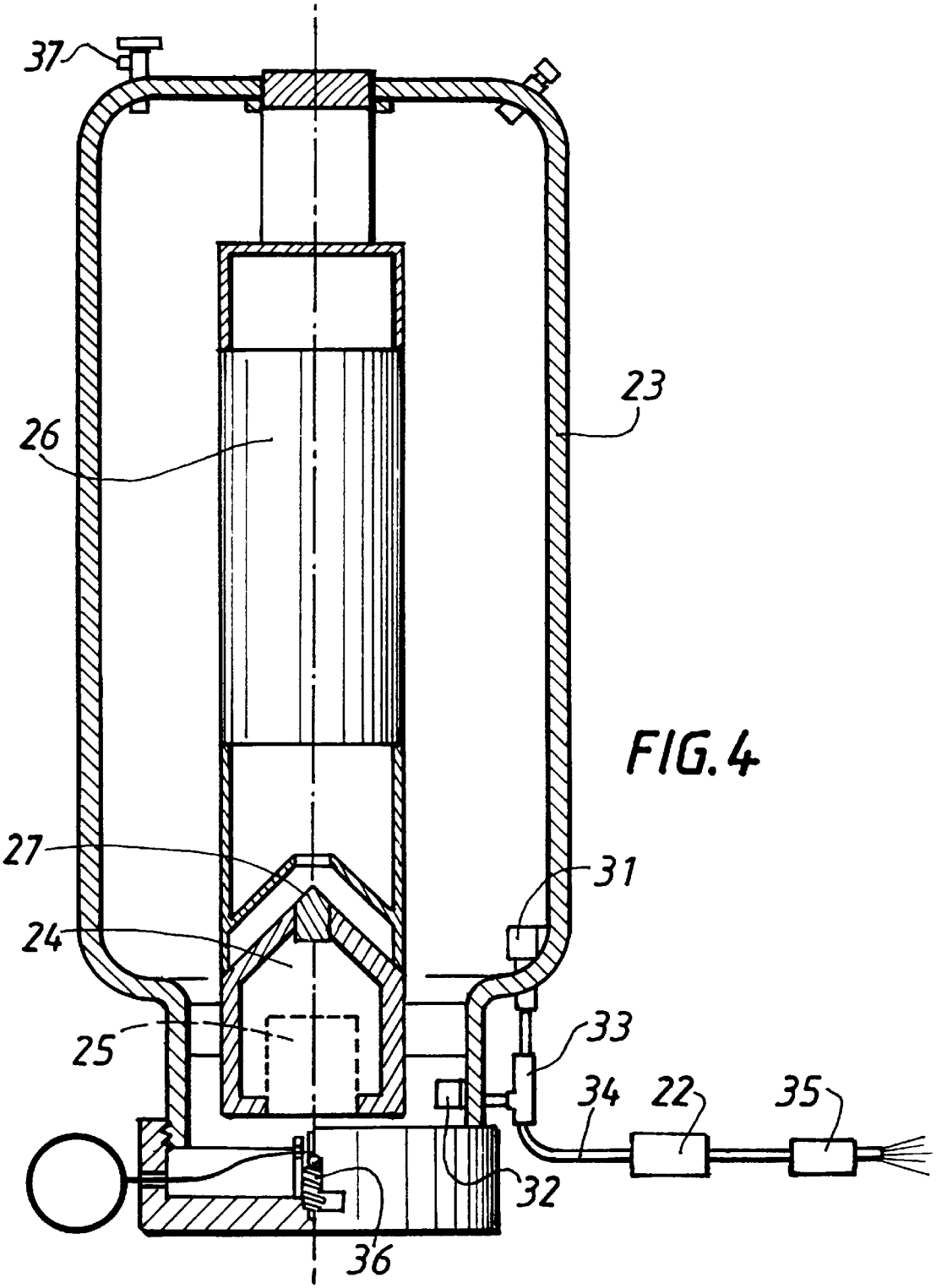
FIG. 4 shows an embodiment of the apparatus of the invention, seen in partial section, and using a pyrotechnic charge.

An embodiment is shown diagrammatically in FIG. 4. In this embodiment, operation is triggered by a pyrotechnic charge in the chamber 25 which generates via the chamber 24 the quantity of gas required and which enables the active substances contained in the envelope 26 to be mixed with the liquid contained in the chamber 23. The liquid contained in a reservoir 23 whose wall is thick enough to withstand a significant increase in pressure. In order to optimize combustion and reduce manufacturing costs, it is advantageous to work with live powder at high charge density. The chamber 25 has openings suitable for delivering nominal pressure enabling conditions of rapid combustion at high pressure to be established, thereby ensuring that all of the substance burns. The high pressure gas is released into the chamber 24. When sufficient pressure is achieved to push out the plug 27, it is propelled into the envelope 26. The top portion of the reservoir includes a valve 37 for bleeding or stirring the liquid by admitting air from a supply of gas under pressure.

The active substances are contained in a tearable envelope 26 in liquid or powder form. The envelope 26 is made of a material, suitable for bursting so as to facilitate passage of the liquid and optimize mixing and dilution of the substance in the liquid, e.g. by having variable wall thickness or weak points over its surface. The liquid can discharge into the Venturi tube 22 via a pipe 34 and a thermostatically controlled mixing valve 33. The valve 33 serves to maintain practically constant temperature in use. Pressure regulators 31 and 32 are preferably mounted upstream from the valve 33 so that both the temperature and the pressure of the liquid are under control. The volume of the foam leaving the apparatus is about five times greater than with apparatuses presently in use. Opening the outlet of the lance 35 sets the liquid into motion which then flows around the envelope 26 helically, thereby facilitating heat exchange.

This embodiment can also be provided with a device for pressurizing the gas to feed the inlet of the Venturi and to adapt the nature of the gas to the looked-for action. For example, the apparatus may be provided with a quick coupling fitted with a pressure-rated valve 38 for boosting gas into the inlet of the Venturi, from the pressure regulator 40 and via the pipe 39.

Figure 5:
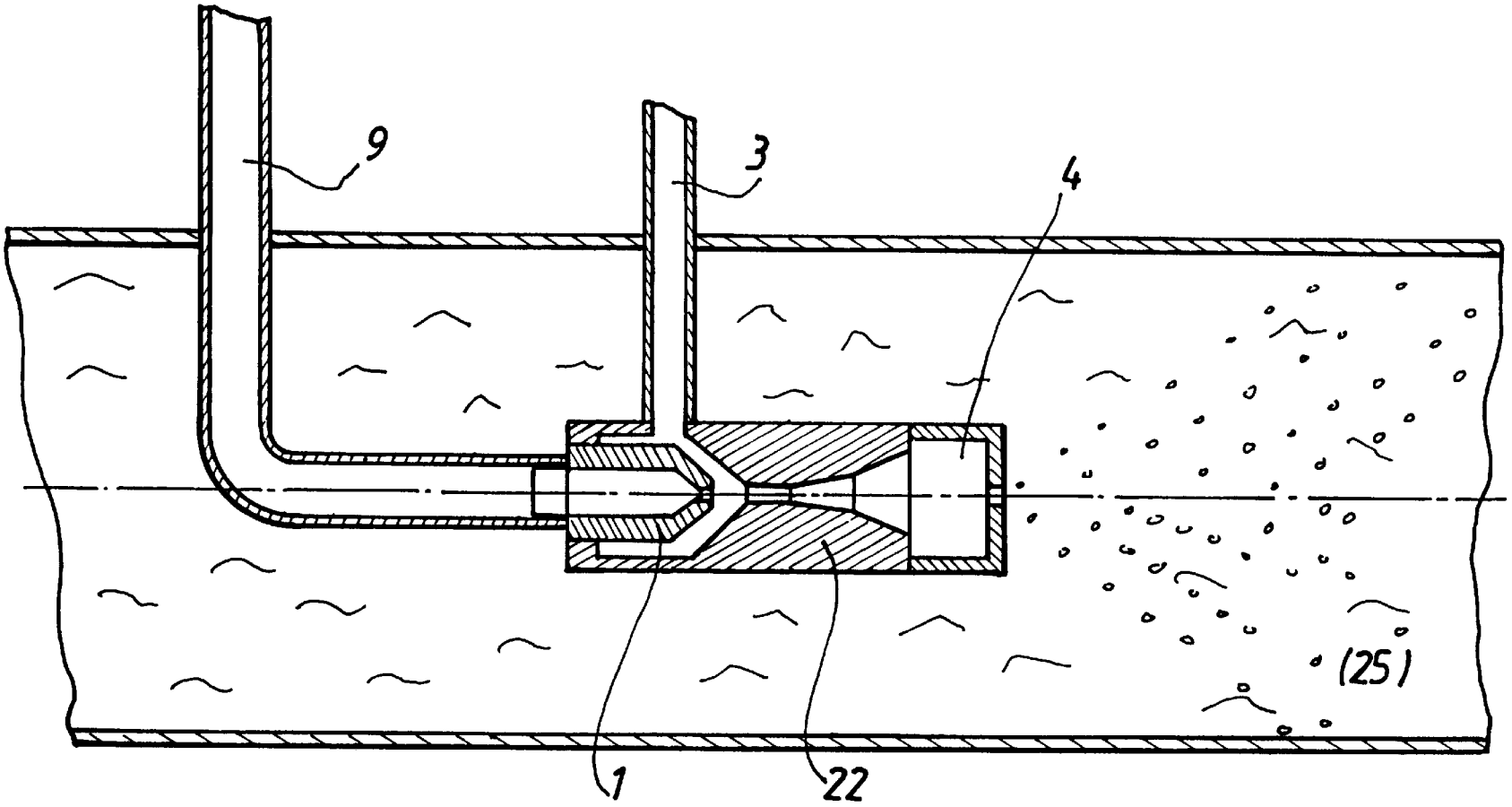
FIG. 5 shows an application of the invention to producing microbubbles.

The present invention also provides apparatus serving to disperse microbubbles of gas in a liquid likewise using the above-described device. In FIG. 5, the Venturi is placed in a liquid duct 25.

The main applications of the method relate to using as the fluid water containing an adequate percentage of active substances for specific actions:

- detergents optionally mixed with any type of solvent as a function of the application, with advantage being given, in accordance with the invention, to polar or ionic compounds and also to surfactants for cleaning applications; and
- substances for neutralizing pollution, and in particular enzymes or proteins specific to certain chemical actions on organic substances and preferably, in accordance with the invention, capable of being mixed with solvents and destructuring substances (for polymerized pollution), or surfactants.

Other applications can be envisaged in which the fluid is not necessarily in an aqueous solution:

- with substances for neutralizing the combustion phenomenon, with surfactants or polar ionic compounds for fire extinguisher applications for any kind of fire; and
- with fuels accompanied by polar and/or surfactant foaming agents, in which case the foam is used by subsequent dispersion via a prior art nozzle without using the cavitation phenomenon.

Another application of the apparatus is to use its pressure-reducing ability which can be greater than 1 bar. Such apparatus can then become the main element of a vacuum pump.

Other applications are possible using in the fluid two substances that are not normally miscible in order to create emulsions, e.g. in the food, cosmetics, or pharmaceutical industries.

What is claimed is:

1. A device for forming foam by the Venturi effect, mixing a substance in liquid phase and a substance in gas phase, the device comprising a liquid insertion nozzle on a same axis as a Venturi stage comprising a converging portion disposed facing the nozzle, the Venturi stave having a throat of diameter "D", and a gas inlet coaxial with the nozzle and in communication with the converging portion, a gas being sucked in by the Venturi effect and directed to a mixing chamber connected to a foam outlet, wherein a diverging portion of the Venturi stage comprises at least three zones of progressive cone angles, with discontinuities between the zones, co-operating with a geometry of the diverging portion to give rise to a cavitation phenomenon, and opening out into a turbulence area of the mixing chamber, mixing between the two phases taking place in a free jet.

2. The device according to claim 1, wherein the diverging portion has three zones of increasing cone angle, the first zone having a cone angle lying in a range of greater than 0° to less than or equal to 10°.

3. The device according to claim 1, wherein a second zone of said at least three zones has a cone angle at least 5° greater than the cone angle of the first zone of said at least three zones, wherein the second zone has an inlet located at a transition between the first zone and the second zone and an outlet located at a transition between the second zone and a third zone of said at least three zones, the second zone inlet having a diameter in a range 2D to 4D and the second zone outlet having a diameter in a range 5D to 8D.

4. The device according to claim 1, wherein the diverging portion includes surface discontinuities comprising one of groove lines and grids.

5. The device according to claim 1, wherein the angles of the conical zones increase continuously and are rounded.

6. The device according to claim 1, wherein a distance between an outlet from the nozzle and an inlet of the Venturi stage lies in a range 2d to 20d, where d is a diameter of a nozzle duct of the nozzle, the diameter of the throat of the Venturi stage lying in a range 1d to 4d.

7. The device according to claim 1, including means for adjusting a length of the mixing chamber.

8. The device according to claim 1, wherein two ultrasound generators are disposed radially relative to the mixing chamber.

9. The device according to claim 1, wherein the Venturi stage has an inlet which is coupled to at least one of a mixer, flow rate regulator and pressure regulator.

10. The device according to claim 1, wherein the Venturi stage section has an inlet which is coupled to at least one mixer and at least one of a flow rate regulator and pressure regulator.

11. The device according to claim 9, wherein at least one mixer is connected to the inlet of each flow rate regulator and pressure regulator.

12. The device according to claim 10, wherein at least one flow rate regulator and pressure regulator is connected to the inlet of each mixer.

13. Apparatus for forming foam, including a device according to claim 1, said apparatus comprising an enclosure containing a liquid, in which an envelope is immersed that contains active substances, a pyrotechnic device causing the active substances to be dissolved in the liquid.

* * * * *